US009723957B2

(12) United States Patent
Firestone

(10) Patent No.: US 9,723,957 B2
(45) Date of Patent: Aug. 8, 2017

(54) SCRUBBING DEVICE FOR ATTACHMENT TO A BAR OF SOAP

(71) Applicant: Lee E. Firestone, Jericho, NY (US)

(72) Inventor: Lee E. Firestone, Jericho, NY (US)

( * ) Notice: Subject to any disclaimer, the term of this patent is extended or adjusted under 35 U.S.C. 154(b) by 218 days.

(21) Appl. No.: 14/723,106

(22) Filed: May 27, 2015

(65) Prior Publication Data

US 2015/0342422 A1 Dec. 3, 2015

Related U.S. Application Data

(60) Provisional application No. 62/003,307, filed on May 27, 2014.

(51) Int. Cl.
*A47K 7/03* (2006.01)
*A47K 5/04* (2006.01)

(52) U.S. Cl.
CPC . *A47K 7/03* (2013.01); *A47K 5/04* (2013.01)

(58) Field of Classification Search
CPC combination set(s) only.
See application file for complete search history.

(56) References Cited

U.S. PATENT DOCUMENTS 2,946,074 A * 7/1960 Caldwell ..... A47K 7/028 15/114
3,498,726 A * 3/1970 Schwartz ..... A47K 5/05 401/19
4,050,825 A * 9/1977 Stein ..... A46B 15/00 15/106
4,621,934 A * 11/1986 Starek ..... A47K 7/03 401/18
5,857,792 A * 1/1999 Iffinger ..... A47K 5/00 401/19
6,210,057 B1 * 4/2001 Yannaci ..... A45D 34/042 401/150
7,503,715 B2 * 3/2009 Khubani ..... A46B 11/0013 401/205

* cited by examiner

*Primary Examiner* — David Walczak
(74) *Attorney, Agent, or Firm* — Nixon Peabody LLP

(57) ABSTRACT

A kit for a scrubbing device having interchangeable scrubbing mechanisms for attachment to a bar of soap includes a base element configured to removably couple to and retain the bar of soap, and a plurality of scrubbing elements each including a different scrubbing mechanism. The base element is configured to be removably and interchangeably coupled to each of the plurality of scrubbing elements.

15 Claims, 3 Drawing Sheets

SCRUBBING DEVICE FOR ATTACHMENT TO A BAR OF SOAP

CROSS-REFERENCE TO RELATED APPLICATIONS

This application claims the benefit of and priority to U.S. Provisional Patent Application No. 62/003,307 titled "Scrubbing Device For Attachment To A Bar Of Soap" and filed on May 27, 2014, which is incorporated herein by reference in its respective entirety.

FIELD OF THE INVENTION

The present invention relates generally to devices for washing or cleaning purposes. In particular, the present invention relates to a scrubbing device for attachment to a bar of soap.

BACKGROUND

A slippery bar of soap has long been a frustrating problem for bathers. The bar of soap is difficult to grip, leading to the commonly experienced problem of the bar of soap falling out of the user's hand. While there have been many attempts to solve this problem with a scrubbing device attached to bar of soap, such prior attempts suffer from a number of disadvantages. For example, some prior scrubbing devices fail to retain the bar of soap after limited use due to inferior retention mechanisms that do not adequately account for the shrinking size of the bar of soap as it is used. Additionally, for example, some prior scrubbing devices require the bar of soap to be integrally formed at the time of manufacture with one or more components of the scrubbing device. Thus, such scrubbing devices were limited to a single use. Still further, some prior scrubbing devices require premature replacement of the bar of soap, wasting substantial portions of the bar of soap.

SUMMARY

According to some aspects of the present disclosure, a scrubbing device for attachment to a bar of soap includes a base element and a scrubbing element. The base element includes a soap-receiving portion having a first-base surface shaped to receive the bar of soap. The base element also includes a base-attachment portion extending from the soap-receiving portion. The base-attachment portion has one or more base-coupling elements. The base element further includes a plurality of base prongs configured to penetrate the bar of soap to couple the base element to the bar of soap. The plurality of base prongs include a first set of one or more prongs extending downwardly from the first-base surface at a steep angle with respect to the first-base surface (i.e., an angle that is generally in a direction that is generally parallel to a thickness of the bar of soap coupled to the base element and perpendicular to a length and a width of a bar of soap coupled to the base element). The scrubbing element is configured to be removably coupled to the base element. The scrubbing element includes a first-scrubbing-element surface configured to receive the bar of soap, a recessed portion relative to the first-scrubbing-element surface configured to receive the base-attachment portion of the base element, one or more scrub-coupling elements configured to couple with the one or more base-coupling elements to retain the base-attachment portion within the recessed portion of the scrubbing element, one or more scrub-prongs extending from the first-scrubbing-element surface that are configured to penetrate the bar of soap to couple the scrubbing element to the bar of soap, and a scrubbing mechanism coupled to a second-scrubbing-element surface.

According to other aspects of the present disclosure, a scrubbing device for attachment to a bar of soap includes a base element coupled to a scrubbing element. The base element includes a first surface configured to receive the bar of soap. The first surface has one or more apertures. The base element also includes a plurality of first prongs extending outwardly from the first surface. The plurality of first prongs is configured to penetrate the bar of soap and couple the bar of soap to the base element. The base element further includes a plurality of bores extending from the first surface into the plurality of first prongs. The scrubbing element includes a scrubbing mechanism coupled to a second surface, and one or more second prongs extending from the second surface through the one or more apertures. The one or more second prongs are configured to penetrate the bar of soap and couple the scrubbing element to the bar of soap. The scrubbing element also includes a plurality of posts extending from the second surface. Each of the plurality of posts is received in a respective one of the plurality of bores of the base element so as to removably couple the scrubbing element to the base element.

According to further aspects of the present disclosure, a kit for a scrubbing device having interchangeable scrubbing mechanisms for attachment to a bar of soap includes a base element configured to removably couple to and retain the bar of soap, and a plurality of scrubbing elements each including a different scrubbing mechanism. The base element is configured to be removably and interchangeably coupled to each of the plurality of scrubbing elements.

The above summary is not intended to represent each embodiment or every aspect of the present invention. Additional features and benefits of the present invention are apparent from the detailed description and figures set forth below.

BRIEF DESCRIPTION OF THE DRAWINGS

Other advantages of the invention will become apparent upon reading the following detailed description and upon reference to the drawings in which.

Figure 1A:
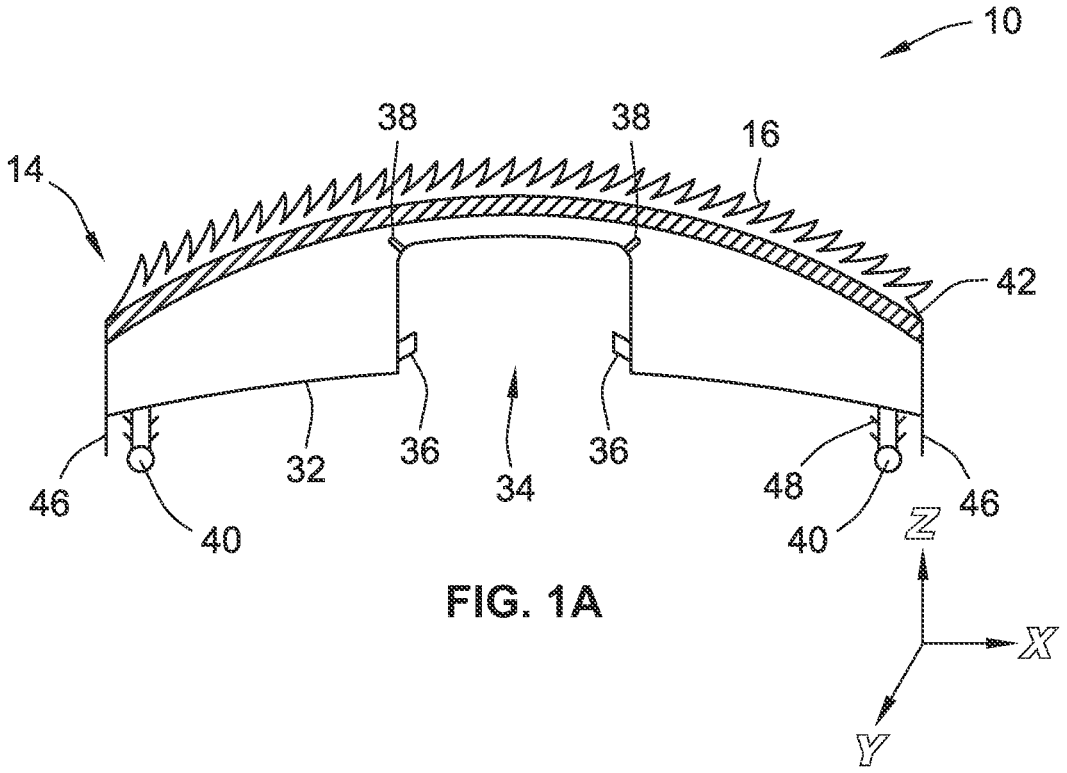
FIG. 1A illustrates a scrubbing element of an exemplary scrubbing device for attachment to a bar of soap according to some aspects of the present disclosure.

While the invention is susceptible to various modifications and alternative forms, a specific embodiment thereof has been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DETAILED DESCRIPTION

Figure 1B:
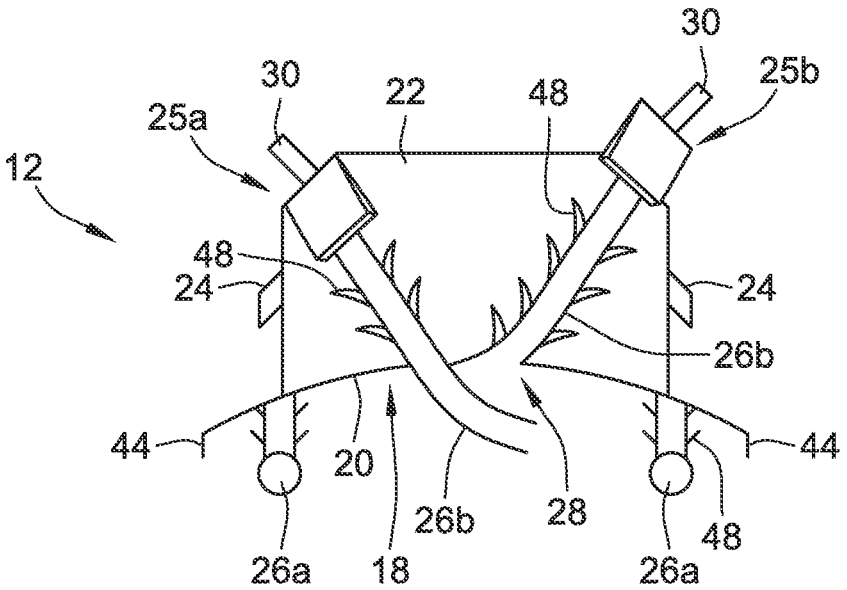
FIG. 1B illustrates a base element configured to be used with the scrubbing element of FIG. 1A, according to one embodiment.

Referring to FIGS. 1A, 1B, an exemplary scrubbing device 10 for attachment to a bar of soap is illustrated according to some aspects of the present disclosure. As shown in FIGS. 1A, 1B, the scrubbing device 10 includes a base element 12 and a scrubbing element 14. More particularly, the base element 12 is configured to be removably coupled to the scrubbing element 14. As will be explained in greater detail below, the removable coupling of these components facilitates easier replacement of a bar of soap and interchangeability of different scrubbing elements 14 having different scrubbing mechanisms 16 (e.g., loofahs, washcloths, sponges, meshes, pumices, brushes, combinations thereof, and/or the like).

The base element 12 includes a soap-receiving portion 18 having a first-base surface 20 shaped to receive the bar of soap. In the exemplary scrubbing device 10 illustrated in FIG. 1B, the first-base surface 20 has a concave shape so as to accommodate a bar of soap having a substantially similar shape; however, it should be understood that the first-base surface 20 can have other shapes including, for example, a generally planar shape. The base element 12 also includes a base-attachment portion 22 extending from the soap-receiving portion 18. The base-attachment portion 22 includes one or more base-coupling elements 24 that are configured to be removably coupled to corresponding features of the scrubbing element 14, which will be described in greater detail below.

The base element 12 further includes a plurality of base prongs 26*a*, 26*b* configured to penetrate the bar of soap to couple the base element 12 to the bar of soap. In the illustrated example, the plurality of base prongs 26*a*, 26*b* include a first set of one or more prongs 26*a* extending downwardly from the first-base surface 20 at a steep angle with respect to the first-base surface 20. That is, the first set of prong(s) 26*a* extend from the first-base surface 20 in a direction that is generally parallel to the direction "Z" shown in FIG. 1A (i.e., a direction that is generally parallel to a thickness of the bar of soap coupled to the base element 12 and perpendicular to a length and a width of a bar of soap coupled to the base element 12).

The plurality of base prongs 26*a*, 26*b* can further include a second set of one or more prongs 26*b* that extend through one or more apertures 28 in the first-base surface 20 to penetrate and thereby couple the bar of soap to the base element 12. In particular, the second set of prong(s) 26*b* extend from the first-base surface 20 at a relatively small angle (e.g., less than an approximately 45 degree angle, less than an approximately 25 degree angle, or less than an approximately 15 degree angle) so as to penetrate and extend into a shallow depth of the bar of soap. Advantageously, because the second set of prongs 26*b* penetrate and extend into the bar of soap at a relatively small angle, the length of the second set of prong(s) 26*b* extending into the bar of soap can be increased (e.g., relative to the length of the first set of prong(s) 26*a*). Accordingly, greater retention of the bar of soap can be achieved within a smaller depth of the bar of soap. This in turn allows for a greater amount of the bar of soap to be used before the base prongs 26*a*, 26*b* protrude through the bar of soap, requiring replacement of the bar of soap. The retention of the bar of soap is also enhanced due to the first set of prongs 26*a* and the second set of prongs 26*b* penetrating the bar of soap at different angles and in different directions.

According to some aspects of the present disclosure, the second set of one or more prongs 26*b* can be movable between an engaged position 25*a* and a disengaged position 25*b* to facilitate insertion of a new bar of soap or removal of a used bar of soap. The second set of one or more prongs 26*b* are configured to penetrate and couple to the bar of soap in the engaged position 25*a*. The second set of one or more prongs 26*b* are configured to be decoupled from the bar of soap in the disengaged position 25*b*. According to some additional aspects, the second set of one or more prongs 26*b* can each further include a grip-portion 30 extending from the base-attachment portion 22 to assist in actuating each of the one or more prongs 26*b* of the second set between the engaged position 25*a* and the disengaged position 25*b*.

As mentioned above, the scrubbing element 14 is configured to be removably coupled to the base element 12. The scrubbing element 14 includes a first-scrubbing-element surface 32 that is configured to receive the bar of soap. Like the first-base surface 20, the first-scrubbing-element surface 32 has a concave shape for the exemplary scrubbing device 10 illustrated in FIGS. 1A, 1B; however, it should be understood that the first-scrubbing-element surface 32 can have other shapes such as, for example, a generally planar shape.

The scrubbing element 14 further includes a base-receiving portion 34 that is configured to receive the base-attachment portion 22 of the base element 12. In particular, the base-receiving portion 34 is defined by a recess relative to the first-scrubbing-element surface 32 configured to receive the base-attachment portion 22 of the base element 12. The base-receiving portion 34 the scrubbing element 14 includes one or more scrub-coupling elements 36 configured to couple with the one or more base-coupling elements 24 to retain the base-attachment portion 22 within the recessed portion 34 of the scrubbing element 14. According to some aspects of the present disclosure, the base-receiving portion 34 can include one or more notches 38 that are configured to receive the one or more grip-portions 30 of the second set of prong(s) 26*b*.

While the base-attachment portion 22 and the base-receiving portion 34 are illustrated as having generally rounded shapes, it should be understood that the base-attachment portion 22 and the base-receiving portion 34 can have other shapes. For example, it is contemplated that according to some aspects, the base-attachment portion 22 and the base-receiving portion 34 can have shapes configured to inhibit rotational and/or axial movement of the base-attachment portion 22 of the base element 12 when received in the base-receiving portion 34 of the scrubbing element 14.

According to some aspects of the present disclosure, the scrubbing element 14 can include one or more scrub-prongs 40 extending from the first-scrubbing-element surface 32 that are configured to penetrate the bar of soap to couple the scrubbing element 14 to the bar of soap. As such, the scrubbing element 14 can also be configured to apply a retention force to the bar of soap coupled to the base element 12. Advantageously, this improves retention of the bar of soap during use. Additionally, for example, the retention provided by the scrub-prong(s) 40 can assist in providing sufficient retention forces to the bar of soap in the event that uneven usage of the bar of soap causes a center portion of the bar of soap to dissolve faster than a peripheral portion of the bar of soap.

The scrubbing element 14 further includes a scrubbing mechanism 16 coupled to a second-scrubbing-element surface 42. As non-limiting examples, the scrubbing mechanism 16 can include one or more loofahs, washcloths, sponges, meshes, pumices, brushes, combinations thereof, and/or the like.

According to some aspects of the present disclosure, the base element 12 can further include a base flange 44 that extends outwardly (e.g., in a direction generally parallel to the direction "Z" in FIG. 1A) from the first-base surface 20. The base flange 44 is configured to penetrate into the bar of soap when the bar of soap is coupled to the base element 12. In this way, the base flange 44 can be configured to inhibit the ingress of liquid (e.g., water) to a central portion of the first-base surface 20 of the base element 12 when the bar of soap is coupled to the base element 12. Advantageously, inhibiting the ingress of liquid mitigates soap dissolution at the underside of the bar of soap (i.e., the side of the bar of soap adjacent to the first-base surface 20, which does not contact a user's skin or other target surfaces when the soap is being used).

It is contemplated that, according to some aspects of the present disclosure, the base flange 44 can form a continuous barrier (i.e., a barrier including no breaks or separation) to improve protection against the ingress of liquid to the central portion of the base element 12. It is further contemplated that, according to additional and/or alternative aspects, the base flange 44 can be located along a peripheral portion of the first-base surface 20 with the plurality of base prongs located within the central portion of the first-base surface 20 so as to protect the retention points between the bar of soap and the base element 12 from dissolution, thereby mitigating problems associated with premature detachment of the bar of soap from the scrubbing device 10.

According to additional and/or alternative aspects of the present disclosure, the scrubbing element 14 can include a scrubbing-element flange 46 that extends outwardly (e.g., in a direction generally parallel to the direction "Z" in FIG. 1A) from the first-scrubbing-element surface 32. The scrubbing-element flange 46 is also configured to penetrate into the bar of soap when the base element 12 and the attached bar of soap are coupled to the scrubbing element 14. In this way, the scrubbing-element flange 46 can be configured to inhibit the ingress of liquid (e.g., water) to a central portion of the first-scrubbing-element surface 32 and the base element 12 when the base element 12 is coupled to the scrubbing element 14. As described above, inhibiting the ingress of liquid mitigates soap dissolution at the underside of the bar of soap (i.e., the side of the bar of soap adjacent to the first-base surface, which does not contact a user's skin or other target surfaces when the soap is being used). Similar to the base flange 44 described above, the scrubbing-element flange 46 can form a continuous barrier and/or can be located on a peripheral portion of the first-scrubbing-element surface 32 with the scrub-prong(s) located on a central portion of the first-scrubbing-element surface 32 to protect the retention points between the scrubbing element 14 and the bar of soap.

According to some aspects of the present disclosure, the retention of the bar of soap to the base element 12 and/or the scrubbing element 14 can be enhanced by providing a plurality of barbs 48 on one or more of the plurality of base prongs 26*a*, 26*b* or the one or more scrub prongs 40. For example, the barbs 48 can be angled back relative to a direction of insertion of the base prongs 26*a*, 26*b* and/or scrub prong(s) 40 such that the barbs 48 provide insignificant resistance against insertion but significant resistance against retraction of the base prongs 26*a*, 26*b* and/or scrub prong(s) 40. The barbs 48 can further enhance retention of the bar of soap to the base element 12 and/or scrubbing element 14 by increasing the number of points of contact between the bar of soap and the base element 12 and/or the scrubbing element 14.

Figure 2:
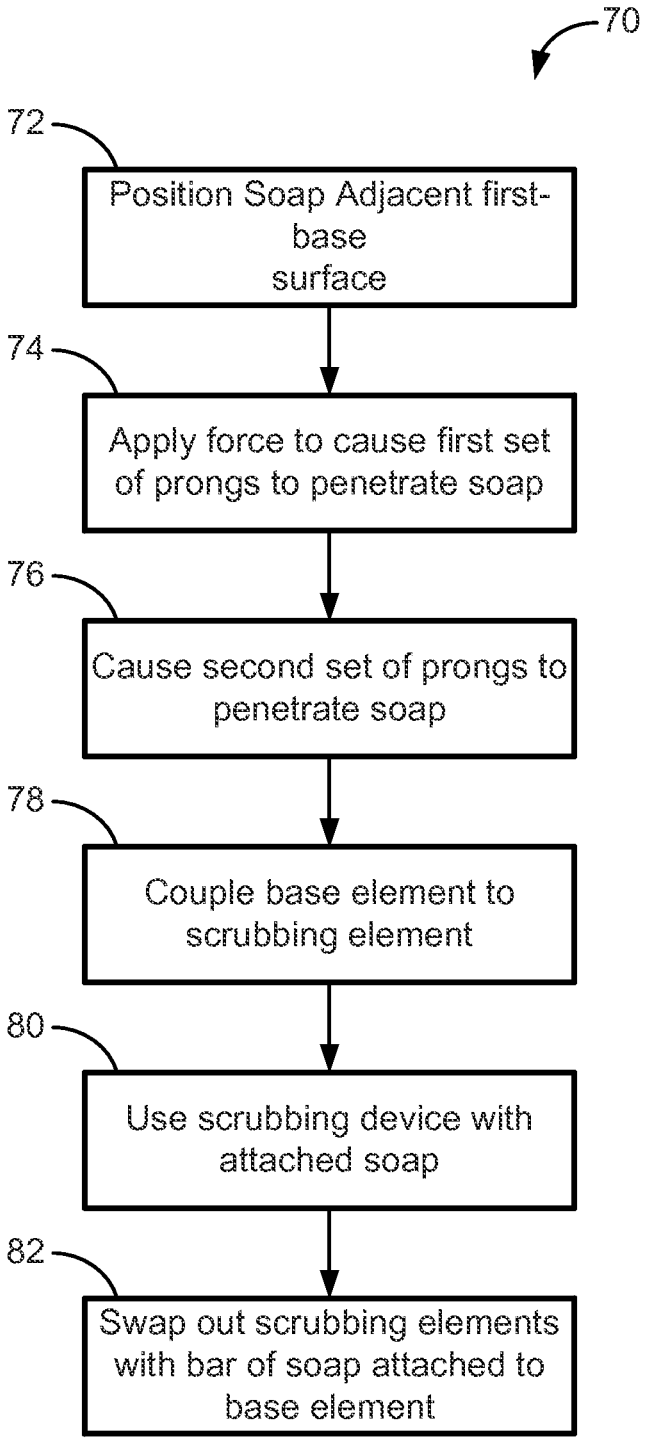
FIG. 2 illustrates an exemplary flowchart for a method of assembling and using the scrubbing device of FIGS. 1A, 1B according to some aspects of the present disclosure.

An exemplary process 70 for the assembly/disassembly and usage of the scrubbing device 10 will now be described with respect to the flow chart illustrated in FIG. 2. At step 72, a bar of soap is positioned adjacent to the base element 12 with the second set of prong(s) 26*b* in the disengaged position 25*b*. At step 74, a force is applied to the bar of soap and/or the base element 12 to cause the first set of prongs 26*a* to penetrate to a first depth within the bar of soap. According to some aspects, the first depth can be determined by the distance that the first set of prongs 26*a* extend from the first-base surface 20 (i.e., the bar of soap can abut the first-base surface 20 after step 72). According to alternative aspects, the first depth can be determined by a different feature acting as a stop to limit the first depth of penetration of the first set of prongs 26*a* such that there is a gap between the underside of the bar of soap and the first-base surface 20. The force applied during step 74 also causes the base flange 44 to penetrate the bar of soap to form a barrier that inhibits the ingress of liquid to the central portion of the first-base surface 20 and, thus, the underside of the bar of soap adjacent to the central portion of the first-base surface 20. It is contemplated that, according to some aspects of the present disclosure, the second-scrubbing-element surface 42 can omit or limit any apertures therein to further inhibit liquid from contacting the underside of the bar of soap.

At step 76, the grip-portions 30 can be actuated to cause the second set of prongs 26*b* to move from the disengaged position 25*b* to the engaged position, 25*a* resulting in the second set of prongs 26*b* penetrating to a second depth within the bar of soap. According to various aspects of the present disclosure, the second depth can be the same as the first depth or the second depth can be different from the first depth. In any event, the first set of prongs 26*a* and the second set of prongs 26*b* can be configured to minimize the first depth and second depth of penetration, thereby maximizing the potential usage of the bar of soap before it must be replaced. As non-limiting examples, the first depth and the second depth can be less than approximately a third of an inch or less than approximately a quarter of an inch.

Upon completion of step 76, the bar of soap has coupled to the base element 12. At step 78, the base element 12 can be coupled to the scrubbing element 14 by inserting the base-attachment portion 22 of the base element 12 into the base-receiving portion 34 of the scrubbing element 14 such that the base-coupling 24 element is coupled to the scrub-coupling element 36. As non-limiting examples, the base-coupling element 24 and the scrub-coupling element 36 can include snap-fit retention features, Velcro, friction-fit retention features (e.g., matching tapered surfaces), combinations thereof, and/or like features suitable for removable coupling. According to one exemplary implementation, the base-coupling element 24 and the scrub-coupling element 36 can be configured such that the base element 12 can be decoupled from the scrubbing element 14 by applying a lateral pressure to the exterior sides of the scrubbing element 14 (e.g., by squeezing the sides of the scrubbing element 14). According to some aspects of the present disclosure, the base-coupling element 24 and the scrub-coupling element 36 can be configured to both axially retain the base-attachment portion 22 within the base-receiving portion 34 and rotationally limit the base-attachment portion 22 with respect to the base-receiving portion 34.

As the base element 12 is being inserted into the recess 34 of the scrubbing element 14, the scrub-prongs 40 penetrate to a third depth within the bar of soap and the scrubbing-element flange 46 penetrates the bar of soap to form a barrier to inhibit ingress of liquid to a central portion of the first-scrubbing-element surface 32 (and the base element 12). The third depth can be the same as the first depth and/or the second depth, or the third depth can be different from the first depth and the second depth. As non-limiting examples, the third depth can be less than approximately a third of an inch or less than approximately a quarter of an inch.

According to some aspects of the present disclosure, when the base element 12 is coupled to the scrubbing element 14, the first-base surface 20 and the first-scrubbing-element surface 32 can be flush and shaped such that a substantially continuous surface is formed for receiving the bar of soap. Advantageously, the flush and substantially continuous surface can facilitate dissolving the bar of soap more evenly. As described above, the flush and substantially continuous surface can have a concave shape or a planar shape. According to additional and/or alternative aspects, the first-base surface 20 and the first-scrubbing-element surface 32 may be offset from one another and/or have differently shaped surface profiles.

Upon completion of step 78, the bar soap has been coupled to the scrubbing device 10. At step 80, the user can use the scrubbing device 10 and attached bar of soap to wash themselves or another target object. For example, the user can hold the scrubbing device 10 with the bar of soap facing away from their hand to apply the bar of soap to the target object and generate soap suds for washing. The user can then turn the scrubbing device 10 over such that the scrubbing mechanism 16 faces the target object to utilize the scrubbing mechanism 16 to scrub the soap suds on the target object. Optionally, at step 82, the user can elect to swap out the attached scrubbing element 14 for a different scrubbing element 14 having a different scrubbing mechanism 16. To do so, the user simply decouples the base element 12 from the attached scrubbing element 14 and then repeats step 76 with the new scrubbing element 14. In other embodiments, the scrubbing mechanism 16 may be detachable from the scrubbing element 14 such that it may be easily replaced with a different type of scrubbing mechanism. Accordingly, the scrubbing device 10 allows the user greater flexibility in the types of scrubbing mechanisms 16 that can easily and conveniently be employed in connection with a common bar of soap.

Figure 3:
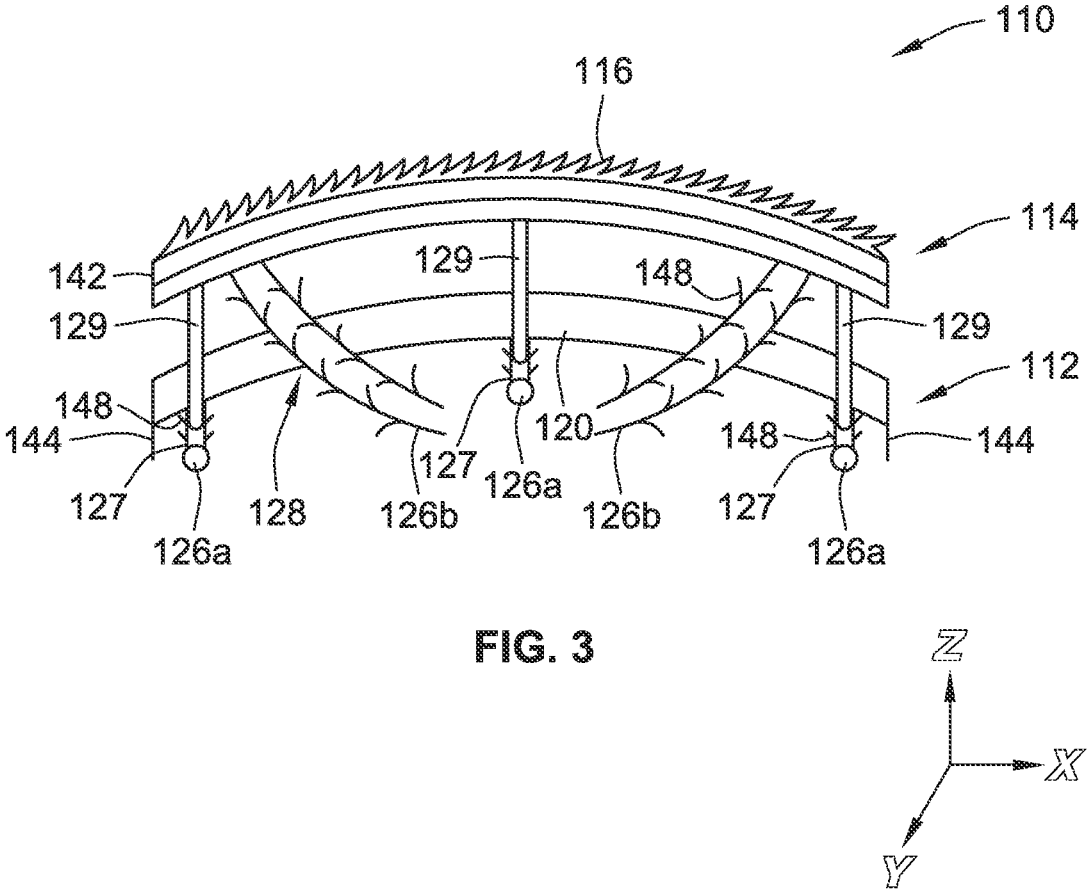
FIG. 3 illustrates an exemplary scrubbing device for attachment to a bar of soap according to some aspects of the present disclosure.

Referring now to FIG. 3, an exemplary scrubbing device 110 is illustrated according to some alternative aspects of the present disclosure. The scrubbing device 110 illustrated in FIG. 3 includes a base element 112 and a removably coupled scrubbing element 114. The base element 112 includes a first surface 120 configured to receive a bar of soap. The first surface 120 can have a shape that is configured to accommodate a shape of the bar of soap. For example, the first surface 120 can have a concave shape or a generally planar shape. The first surface 120 includes one or more apertures 128 therein.

The base element 112 further includes a plurality of first prongs **126*a* extending outwardly from the first surface 120 in a direction that is generally parallel to a direction "Z" shown in FIG. 3 (i.e., a direction that is generally parallel to a thickness of the bar of soap coupled to the base element 112 and perpendicular to a length and a width of a bar of soap coupled to the base element 112). The first prongs 126*a* are configured to penetrate the bar of soap to couple the bar of soap to the base element 112. The base element 112 further includes a plurality of bores 127 extending from openings in the first surface 120 into the plurality of first prongs 126*a***.

The scrubbing element 114 includes a scrubbing mechanism 116 coupled to a second surface 142, one or more second prongs **126*b* extending from the second surface 142 through the one or more apertures 128 of the first surface 120, and a plurality of posts 129 extending from the second surface 142 in a direction that is generally parallel to the direction the first prongs 126*a* extend from the first surface 120. As non-limiting examples, the scrubbing mechanism 116 can include one or more loofahs, washcloths, sponges, pumices, meshes, brushes, combinations thereof, and/or the like. Each of the plurality of posts 129 is received in a respective one of the plurality of bores 127 of the base element 112 so as to removably couple the scrubbing element 114 to the base element 112. The one or more second prongs 126*b* are configured to penetrate the bar of soap and couple the scrubbing element 114 to the bar of soap. According to some aspects, the second surface 142 can be shaped to generally correspond to the shape of the first surface 120; however, it should be understood that the second surface 142** can have other shapes as well.

The plurality of first prongs **126*a* and the plurality of second prongs 126*b* of the scrubbing device 110 of FIG. 3 can be configured to penetrate and retain the bar of soap in a manner similar to the first set of prongs 26*a* and the second set of prongs 26*b*, respectively, described and illustrated above with respect to FIG. 1B. For example, the first prongs 126*a* can penetrate the bar of soap to a first depth in the direction that is generally parallel to the direction "Z" shown in FIG. 3 (i.e., a direction that is generally parallel to a thickness dimension of the bar of soap coupled to the base element 112 and perpendicular to a length dimension and a width dimension of a bar of soap coupled to the base element 112). Additionally, for example, the second prongs 126*b* can extend from the first surface 120 at a relatively small angle (e.g., less than an approximately 45 degree angle, less than an approximately 25 degree angle, or less than an approximately 15 degree angle) so as to penetrate to a shallow, second depth of the bar of soap. Advantageously, because the second prongs 126*b* penetrate and extend into the bar of soap at a relatively small angle, the length of the second prong(s) 126*b* extending into the bar of soap can be increased to provide greater retention of the bar of soap within a smaller depth of the bar of soap. This in turn allows for a greater amount of the bar of soap to be used before the second prongs 126*b*** protrude through the bar of soap, at which point the bar of soap requires replacement.

It is contemplated that, according to some aspects of the present disclosure, the first prongs **126*a* and the second prongs 126*b* can include a plurality of barbs 148 as described above with respect to FIG. 1B. Additionally, according to some aspects, the first surface 120 can include a base flange 144 configured to penetrate into the bar of soap and form a barrier that substantially inhibits ingress of liquids to a central portion of the first surface 120** and the adjacent underside of the bar of soap. As described above, inhibiting the ingress of liquid mitigates soap dissolution at the underside of the bar of soap (i.e., the side of the bar of soap adjacent to the first surface, which does not contact a user's skin or other target surfaces when the soap is being used).

To assemble the scrubbing device 110, the plurality of posts 129 of the scrubbing element 114 are inserted into the plurality of bores 127 of the base element 112 so as to couple the scrubbing element 114 to the base element 112. Then the bar of soap is positioned adjacent to the base element 112 and a force is applied to cause the first prongs **126*a* and the second prongs 126*b* to penetrate the bar of soap. The user may then use the scrubbing device 110 and attached bar of soap by applying the combination while the device 110 is oriented with either the scrubbing mechanism 116** or the bar of soap facing the target.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A scrubbing device for attachment to a bar of soap, comprising:

a base element including:

a soap-receiving portion having a first-base surface configured to receive the bar of soap, a base-attachment portion extending from the soap-receiving portion, the base-attachment portion having one or more base-coupling elements, a plurality of base prongs configured to penetrate the bar of soap to couple the base element to the bar of soap, the plurality of base prongs including a first set of one or more prongs extending downwardly from the first-base surface at a steep angle with respect to the first-base surface; and a scrubbing element configured to be removably coupled to the base element, the scrubbing element including:

a first-scrubbing-element surface configured to receive the bar of soap;

a recessed portion relative to the first-scrubbing-element surface configured to receive the base-attachment portion of the base element;

one or more scrub-coupling elements configured to couple with the one or more base-coupling elements to retain the base-attachment portion within the recessed portion of the scrubbing element;

one or more scrub-prongs extending from the first-scrubbing-element surface that are configured to penetrate the bar of soap to couple the scrubbing element to the bar of soap; and a scrubbing mechanism coupled to a second-scrubbing-element surface.

2. The scrubbing device of claim 1, wherein the scrubbing mechanism is selected from the group consisting of a loofah, a washcloth, a sponge, a brush, a pumice, or a mesh.

3. The scrubbing device of claim 1, wherein each of the plurality of base prongs and each of the one or more scrub-prongs includes a plurality of barbs configured to provide a plurality of retention points for retaining the bar of soap to the base element and the scrubbing element when the plurality of base prongs and the one or more scrub-prongs penetrate the bar of soap.

4. The scrubbing device of claim 1, wherein the plurality of base prongs further includes a second set of one or more prongs that extend through one or more apertures in the first-base surface at a shallow angle with respect to the first-base surface.

5. The scrubbing device of claim 4, wherein the second set of one or more prongs are movable between an engaged position and a disengaged position, the second set of one or more prongs being configured to penetrate and couple to the bar of soap in the engaged position, the second set of one or more prongs being configured be decoupled from the bar of soap in the disengaged position.

6. The scrubbing device of claim 5, wherein the second set of one or more prongs each further includes a grip-portion extending from the base-attachment portion, the grip-portion being configured to assist in actuating each of the one or more prongs of the second set between the engaged position and the disengaged position.

7. The scrubbing device of claim 6, wherein the recessed portion of the scrubbing element includes one or more notches configured to receive the one or more grip-portions when the base-attachment portion is received within recessed portion of the scrubbing attachment.

8. The scrubbing device of claim 1, further comprising a base-flange portion extending outwardly from the first-base surface, the base-flange portion being configured to penetrate the bar of soap so as to form a barrier inhibiting ingress of liquid to a central portion of the first-base surface.

9. The scrubbing device of claim 8, wherein the base-flange portion extends substantially around a perimeter of the first-base surface.

10. The scrubbing device of claim 1, further comprising a scrubbing-element-flange portion extending outwardly from the first-scrubbing-element surface, the scrubbing-element-flange portion being configured to penetrate the bar of soap so as to form a barrier inhibiting ingress of liquid to a central portion of the first-scrubbing-element surface.

11. The scrubbing device of claim 1, wherein the first-base surface and the first-scrubbing-element surface are substantially flush when the base element is received in the recessed portion the scrubbing element.

12. The scrubbing device of claim 11, wherein the first-base surface and the first-scrubbing-element surface form a continuous surface having a concave shape configured to receive the bar of soap.

13. A scrubbing device for attachment to a bar of soap, comprising:

a base element, including:

a first surface configured to receive the bar of soap, the first surface having one or more apertures, a plurality of first prongs extending outwardly from the first surface, the plurality of first prongs being configured to penetrate the bar of soap and couple the bar of soap to the base element, and a plurality of bores extending from the first surface into the plurality of first prongs;

a scrubbing element, including:

a scrubbing mechanism coupled to a second surface, one or more second prongs extending from the second surface through the one or more apertures, the one or more second prongs being configured to penetrate the bar of soap and couple the scrubbing element to the bar of soap, a plurality of posts extending from the second surface, each of the plurality of posts being received in a respective one of the plurality of bores of the base element so as to removably couple the scrubbing element to the base element.

14. The scrubbing device of claim 13, wherein each of the plurality of first prongs and each of the one or more second prongs includes a plurality of barbs configured to provide a plurality of retention points for retaining the bar of soap to the base element and the scrubbing element when the plurality of first prongs and the one or more second prongs penetrate the bar of soap.

15. The scrubbing device of claim 13, wherein the scrubbing mechanism is selected from the group consisting of a loofah, a washcloth, a sponge, a brush, a pumice or a mesh.

* * * * *